US005279103A

United States Patent [19]

Stahlecker et al.

[11] Patent Number: 5,279,103

[45] Date of Patent: Jan. 18, 1994

[54] SPINNING MACHINE HAVING A DELIVERY ROLLER WITH A DELIVERY SPEED LESS THAN THE FEEDING SPEED OF FEEDING ROLLERS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 887,807

[22] Filed: May 26, 1992

[30] Foreign Application Priority Data

May 25, 1991 [DE] Fed. Rep. of Germany ..... 4117176

[51] Int. Cl.[5] ..... D01H 13/04

[52] U.S. Cl. ..... 57/90

[58] Field of Search ..... 57/90, 315, 75

[56] References Cited

U.S. PATENT DOCUMENTS 2,896,269 7/1959 Gardella et al. ..... 57/315 X 3,063,231 11/1962 Livingston ..... 57/90

3,191,375 6/1965 Naegeli ..... 57/315 X 3,312,050 4/1967 Noguera ..... 57/315 X 3,816,991 6/1974 Takeuchi et al. ..... 57/90

FOREIGN PATENT DOCUMENTS 1179840 10/1964 Fed. Rep. of Germany ..... 57/90

1015780 1/1966 United Kingdom .

*Primary Examiner*—Joseph J. Hail, III

*Attorney, Agent, or Firm*—Evenson, McKeown, Edwards & Lenahan

[57] ABSTRACT

In the case of a spinning machine having several spinning stations which each comprise a drafting unit to which slivers are fed from cans by means of transport devices, one pair of delivery rollers respectively is provided, the delivery speed of which is lower by approximately 1% to approximately 2% than the feeding speed of the pair of feeding rollers of the drafting unit.

18 Claims, 1 Drawing Sheet

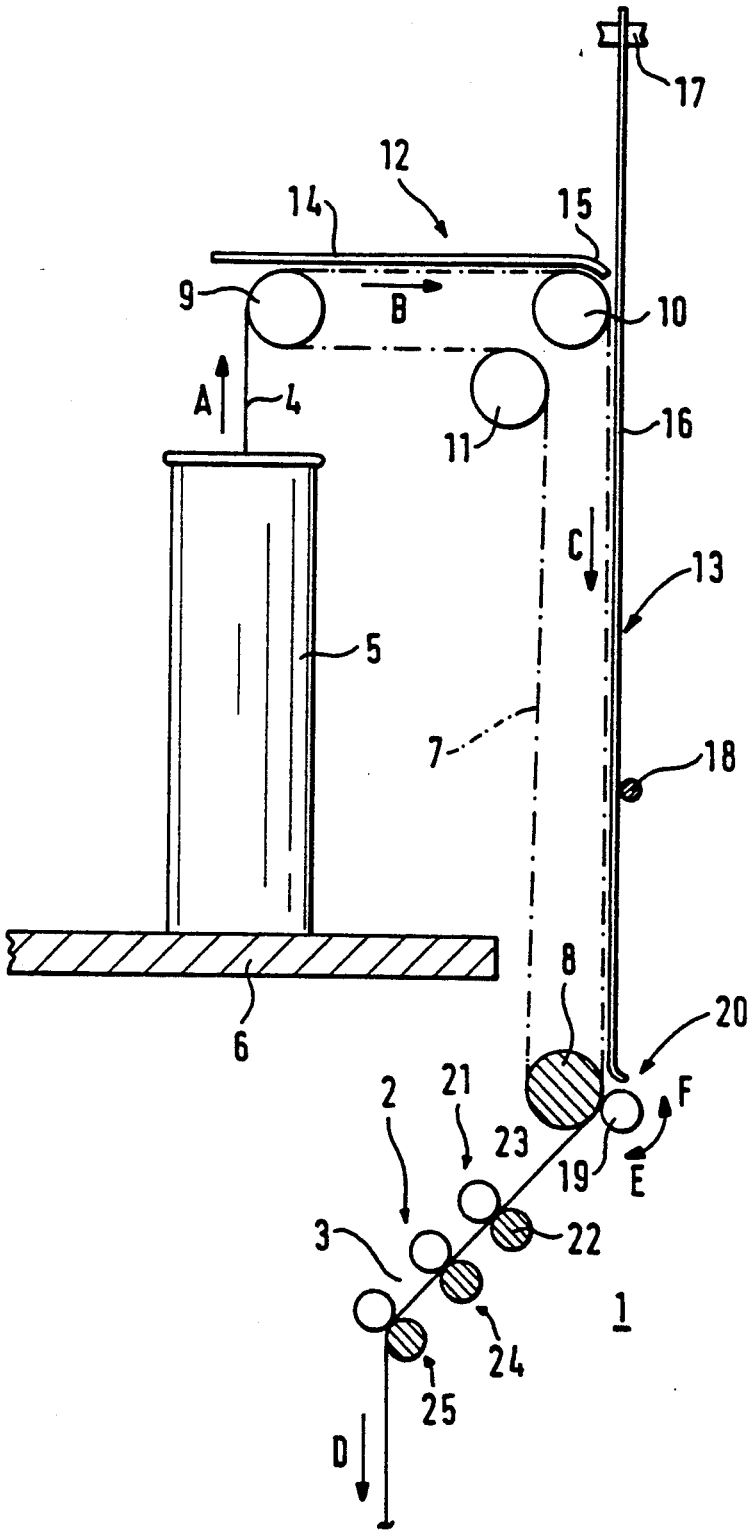
17
12
14
15
9
B
10
A
4
11
16
C
13
5
7
18
8
20
6
2
21
F
23
19
E
3
22
1
24
25
D

SPINNING MACHINE HAVING A DELIVERY ROLLER WITH A DELIVERY SPEED LESS THAN THE FEEDING SPEED OF FEEDING ROLLERS

BACKGROUND AND SUMMARY OF THE INVENTION

This invention relates to a spinning machine having several spinning stations which are arranged on at least one side of the machine and each comprise a drafting unit. Depositing sites for cans are provided which receive the fiber material to be spun in the form of slivers. Transport devices for transporting the slivers from the cans to the drafting units are provided which each comprise one pair of delivery rollers which is connected in front of a pair of feeding rollers of the pertaining drafting unit.

It is known (British Patent Document 1 015 780) to feed the fiber material to be spun to a ring spinning machine in the form of slivers which are withdrawn from cans. The cans are deposited in several rows in front of the ring spinning machine. The slivers are withdrawn from the cans by way of rollers arranged above the cans and are guided to the drafting units of the individual spinning stations by means of transport belts. In this case, transport belts are provided which are in each case arranged in pairs, receive the slivers between one another and guide them. In the area of the drafting units, deflecting rollers of the transport belts are situated which are used as a pair of delivery rollers by means of which the slivers are in each case fed to a drafting unit. A friction roller is assigned to one of the deflecting rollers and can be brought between this deflecting roller and a bottom roller of the drafting unit so that the drive of the delivery roller pair and thus of the transport belts is diverted from the bottom feeding roller. The delivery speed of the pair of delivery rollers should therefore correspond to the feeding speed of the pair of feeding rollers of the drafting unit.

In an older German Patent Application (P 41 09 096.9), which is no prior publication, it was also suggested to let the pair of delivery rollers run at such a speed that a preliminary draft is created between the delivery roller pair and the feeding roller pair of the drafting unit so that the delivery roller pair participates in the overall draft of the sliver and thus, in a sense, is part of the drafting unit.

It is an object of the invention to develop a spinning machine of the initially mentioned type such that clear and defined conditions exist with respect to the draft during the whole operating time.

This object is achieved in that the delivery speed of the delivery roller pairs is approximately 1% to approximately 2% less than the feeding speed of the feeding roller pairs.

In this manner, it is ensured that the slivers are held in a tensioned manner between the delivery roller pairs and the feeding rollers pairs of the drafting units without any resulting draft, or at least without any draft that in practice would be important with respect to the overall draft of the drafting unit. In this case, the invention is based on the recognition that in practice certain fluctuations or irregularities in the feeding of the slivers are unavoidable. In practice, the slivers do not enter into the transport devices in a precisely straight manner but rather in a slightly wave form which is more or less pronounced. The transport devices have the result that the slivers are possibly somewhat stretched and slightly lengthened, in which case, however, because of the wave shape, different sliver lengths are furnished. When the drafting inside the drafting unit takes place with these different sliver lengths, unacceptably large draft deviations may occur in the drafting unit so that the yarn quality is negatively affected. This danger exists also when a (slight) preliminary draft occurs between the delivery roller pair and the feeding roller pair of the drafting unit. By means of the invention, it is provided that the slivers are slightly pretensioned between the delivery roller pair and the feeding roller pair of the drafting unit, without any resulting draft. As a result, the sliver lengths entering into the drafting unit are rendered uniform so that the drafting values can be maintained with high accuracy.

In an expedient further development of the invention, it is also provided that the distance between the delivery roller pairs and the pertaining feeding roller pairs of the drafting units is larger in the sliver travelling direction than the staple length of the spun fiber material. Preferably, the distance amounts to a multiple of the staple length. As a result, it is ensured that the pretensioning of the slivers takes place along a considerable length without any arising damage or undesirable drafts in the slivers.

Other objects, advantages and novel features of the present invention will become apparent from the following detailed description of the invention when considered in conjunction with the accompanying drawings.

BRIEF DESCRIPTION OF THE DRAWINGS

The single drawing FIGURE is a schematic representation of a partial cross-sectional view of a spinning machine, in which case the fiber material to be spun is fed to the drafting unit of the spinning stations as a sliver by means of transport devices which take the sliver in each case out of a can deposited above the spinning machine, constructed according to a preferred embodiment of the invention.

DETAILED DESCRIPTION OF THE DRAWINGS

Only one spinning station 2 with its drafting unit 3 is shown of a spinning machine 1 which preferably is a ring spinning machine. As a rule, a spinning machine of this type comprises a plurality of such spinning stations on both sides which are arranged next to one another in the longitudinal direction of the machine. The drafting units 3 are constructed as three-cylinder drafting units. Relatively fine slivers 4 are fed to the drafting units 3; that is, slivers 4 of a size of approximately Nm 0.3 to Nm 0.8. These slivers 4 are withdrawn from cans 5 which are deposited above the spinning machine 1 on a platform 6. Since the diameter of the cans 5, as a rule, is larger than the spacing of the spinning machine; that is, the distance between the individual spinning stations 2, the cans 5, in a manner not shown in detail, are deposited on each side of the machine in several rows extending in the longitudinal direction of the machine.

In order to avoid a draft of the fine slivers 4 during the transport from the cans 5 to the drafting units 3, the slivers 4 are guided by means of transport devices from the cans 5 to the drafting units 3. These transport devices are formed by a transport belt 7 which is guided around deflecting rollers 8, 9, 10, 11 in such a manner that its sliver-carrying end has an angular course with an approximately horizontal run 12 starting above the cans 5 and a run 13 leading downward, approximately in the machine center, toward the drafting units 3. The transport belts 7 are designed to be so wide that they can each transport two slivers 4. These two slivers 4 are fed to two adjacent drafting units 3; that is, to drafting units 3 which, in a known manner, have joint pressure roller twins as the top rollers 23.

The sliver-carrying end of the transport belts 7 is covered by skids 14, 16. The skid 14, which is assigned to the approximately horizontal run 12, rests with its own weight on the transport belt 7 or the slivers 4 transported by this transport belt 7. On its end, the skid 14 has a deflecting guide 15 which deflects the slivers 4 in the area of the deflecting roller 10 downward to the downward-leading run 13. The skid 16 is preferably made of a spring steel sheet and on its upper end is suspended on a suspension 17. In the area of run 13, this skid 16, by means of one or several rods 18 extending through in the longitudinal direction of the machine, is pressed against the transport belt 7 with a defined prestressing.

On the end of the vertical run 13 of the transport belt 7, a drivable deflecting roller 8 is disposed which is preferably constructed as a roller which extends in the longitudinal direction of the machine and is driven on the machine end. In a known manner, the drive takes place corresponding to the drive of the bottom rollers 22, 24, 25 of the three-cylinder drafting units 3 in a gear case of the machine end.

A pressure roller 19 is assigned to the deflecting roller 8 and extends in each case along the area of two slivers 4 and forms a pair of delivery rollers 20 together with the deflecting roller 8. The deflecting roller 8 has a diameter of at least 45 mm so that it permits a secure drive of the transport belts 7. In contrast, the pressure roller 19 has a smaller diameter, its diameter preferably corresponding to the diameter of the top rollers 23 of the three-cylinder drafting unit 3. As indicated by means of the arrows (E and F), the pressure roller 19 can be adjusted in the circumferential direction of the deflecting roller 8.

The slivers 4 are withdrawn upward in the direction of the arrow (A) by way of the deflecting roller 9 arranged above the cans 5 and are then guided in the direction of the arrow (B) to the machine center. In the area of the machine center, they are guided downward in the direction of the arrow (C) and will then travel into the drafting units 3. There, they are drafted to the desired size and then travel in the direction of the arrow (D) to a twist-providing element, particularly to a ring spindle of a ring spinning machine.

Practical tests have shown that the delivered lengths of the slivers 4 as a rule are slightly larger than what would correspond to the circumferential speed of the pair of delivery rollers 20. The probable reason is essentially that the slivers 4 are not fed to the transport belts in a stretched-out position but in a sort of wave shape. Even when these wave shapes are slightly stretched out in the area of the transport belts 7 and of the skids 14, 16, this wave shape will remain. The danger therefore exists that the slivers 4 enter into the drafting units 3 with different lengths so that deviations occur from the desired drafts. On the other hand, there is the risk that, because of the fed larger lengths, a loop is formed in the area between the delivery roller pair 20 and the feeding roller pair 21 of the drafting units 3 which, after a moderately long operating time, can result in considerable disturbances. Tests carried out with a view to avoiding this danger indicated that it is advantageous for the delivery speed of the pair of delivery rollers 20 to be between approximately 1% and approximately 2%, preferably 1.5%, lower than the feeding speed of the pair of feeding rollers 21 of the drafting units 3. In this manner, the slivers 4 are slightly tensioned and stretched between the delivery roller pairs 20 and the feeding roller pairs 21 so that the length is rendered uniform without, however, any resulting draft, that is, a relative movement of the fibers with respect to one another, occurring in the slivers 4. In this case, it is advantageous for the distance between the delivery roller pairs 20 and the pertaining feeding roller pairs 21 of the drafting units 3 to amount to a multiple of the staple length of the spun sliver. In this case, the fed lengths are rendered particularly uniform.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A spinning machine arrangement including a plurality of spinning stations, each spinning station comprising:

a drafting unit having a bottom roller, a depositing site for a can which receives fiber material to be spun int the form of a sliver, and a transport device for transporting the sliver from the can to the drafting unit, the transport device comprising a delivery roller which is connected in front of a pair of feeding rollers of the pertaining drafting unit one of which is the bottom roller, wherein the bottom roller and the delivery roller are cylinders which extend in the longitudinal direction of the spinning machine arrangement through the plurality of spinning stations, the cylinders being independently driven on at least one end, wherein the delivery speed of the delivery roller is lower than the feeding speed of the pair of feeding rollers by 1% to 2%.

2. A spinning machine according to claim 1, wherein the distance between the delivery roller and the pertaining pairs of feeding rollers of the drafting units is larger than the staple length of the fiber material to be spun.

3. A spinning machine according to claim 2, wherein a plurality of said spinning stations are provided adjacent one another at a spinning machine side, said plurality of spinning stations being driven by a common drive arrangement.

4. A spinning machine according to claim 1, wherein the transport devices have transport belts, the sliver-conveying ends of which transport belts are covered by skids.

5. A spinning machine according to claim 4, wherein the sliver-carrying transport belts each have a run leading from the cans deposited above the spinning machine to the machine center and a run leading dowwnard into the area of the drafting units, the downward-leading run ending with a drivable deflecting roller serving as the delivery roller and further comprising a counterroller assigned to the deflecting roller for formation of a pair of delivery rollers.

6. A spinning machine according to claim 5, wherein the distance between the pairs of delivery rollers and the pertaining pairs of feeding rollers of the drafting units is larger than the staple length of the fiber materials to be spun.

7. A spinning machine according to claim 5, wherein a plurality of said spinning stations are provided adjacent one another at a spinning machine side, said plurality of spinning stations being driven by a common drive arrangement.

8. A spinning machine according to claim 4, wherein the distance between the pairs of delivery rollers and the pertaining pairs of feeding rollers of the drafting units is larger than the staple length of the fiber material to be spun.

9. A spinning machine according to claim 1, wherein a plurality of said spinning stations are provided adjacent one another at a spinning machine side, said plurality of spinning stations being driven by a common drive arrangement.

10. A spinning machine arrangement including at least one spinning station, each spinning station comprising:

a drafting unit, a depositing site for a can which receive fiber material to be spun in the form of a sliver, a transport device for transporting the sliver from the cans to the drafting unit, the transport device comprising one pair of delivery rollers which is connected in front of a pair of feeding rollers of the pertaining drafting unit, wherein the delivery speed of the pair of delivery rollers is lower than the feeding speed of the pair of feeding rollers by 1% to 2%, wherein the transport devices have transport belts, the sliver-conveying ends of which transport belts are covered by skids, wherein the sliver-carrying ends of the transport belts each have a run leading from the cans deposited above the spinning machine to the machine center and a run leading downward into the area of the drafting units, the downward-leading run ending with a drivable deflecting roller to which a counterroller is assigned for the formation of the pair of delivery rollers, and wherein the counterroller is arranged to be adjustable in the circumferential direction of the deflecting roller.

11. A spinning machine according to claim 10, wherein the distance between the pairs of delivery rollers and the pertaining pairs of feeding rollers of the drafting units is larger than the staple length of the fiber material to be spun.

12. A spinning machine according to claim 10, wherein a plurality of said spinning stations re provided adjacent one another at a spinning machine side, said plurality of spinning stations being driven by a common drive arrangement.

13. A spinning machine arrangement including a plurality of spinning stations, each spinning station comprising:

a drafting unit having a bottom roller, a depositing unit having a bottom roller, a depositing site for a can which receives fiber material to be spun in the form of a sliver, and a transport device for transporting the sliver from the can to the drafting unit, the transport device comprising a delivery roller which is connected in front of a pair of feeding rollers of the pertaining drafting unit one of which is the bottom roller, wherein the bottom roller and the delivery roller are cylinders which extend in the longitudinal direction of the spinning machine arrangement through the plurality of spinning stations, the cylinders being independently driven on at least one end wherein the delivery speed of the delivery roller is lower than the feeding speed of the pair of feeding rollers by 1% to 2%.

14. A spinning machine according to claim 13, wherein the distance between the delivery roller and the pertaining pairs of feeding rollers of the drafting units is large than the staple length of the fiber material to be spun.

15. A spinning machine according to claim 13, wherein the sliver-carrying ends of the transport belts each have a run leading from the cans deposited above the spinning machine to the machine center and a run leading downward into the area of the drafting units, the downward-leading run ending with a drivable deflecting roller serving as the delivery roller and further comprising a counterroller assigned to the deflecting roller for formation of a pair of delivery rollers.

16. A spinning machine according to claim 15, wherein the distance between the pairs of delivery rollers and the pertaining pairs of feeding rollers of the drafting units is larger than the staple length of the fiber material to be spun.

17. A spinning machine according to claim 16, wherein a plurality of said spinning stations are provided adjacent one another at a spinning machine side, said plurality of spinning stations being driven by a common drive arrangement.

18. A spinning machine according to claim 13, wherein a plurality of said spinning stations are provided adjacent one another at a spinning machine side, said plurality of spinning stations being driven by a common drive arrangement.

* * * * *